US012790970B2

(12) United States Patent
Anonich et al.

(10) Patent No.: US 12,790,970 B2
(45) Date of Patent: Nov. 10, 2026

(54) EMISSIONS CONTROL SYSTEM

(71) Applicant: Generac Power Systems, Inc., Waukesha, WI (US)

(72) Inventors: Noah Frank Anonich, Waukesha, WI (US); Stephen Paul Schroeder, Waukesha, WI (US); Antonio Charles Carini, West Allis, WI (US); Daniel Karl Schlepp, Sussex, WI (US); Enrique Torres Guzman, Caledonia, WI (US)

(73) Assignee: Generac Power Systems, Inc., Waukesha, WI (US)

( * ) Notice: Subject to any disclaimer, the term of this patent is extended or adjusted under 35 U.S.C. 154(b) by 102 days.

(21) Appl. No.: 18/592,085

(22) Filed: Feb. 29, 2024

(65) Prior Publication Data

US 2024/0309788 A1 Sep. 19, 2024

Related U.S. Application Data

(60) Provisional application No. 63/451,819, filed on Mar. 13, 2023.

(51) Int. Cl.
*F01N 3/20* (2006.01)

(52) U.S. Cl.
CPC ..... *F01N 3/208* (2013.01); *F01N 2610/142* (2013.01); *F01N 2610/1433* (2013.01); *F01N 2610/1493* (2013.01)

(58) Field of Classification Search
CPC ..... F01N 3/208; F01N 2610/142; F01N 2610/1433; F01N 2610/1493
See application file for complete search history.

(56) References Cited

U.S. PATENT DOCUMENTS

| | | | | |
|---|---|---|---|---|
| 9,038,678 | B2 * | 5/2015 | Wright | F01N 3/2066 60/299 |
| 10,794,257 | B2 | 10/2020 | Fell et al. | |
| 2009/0028729 | A1 | 1/2009 | Jochumsen et al. | |
| 2011/0242157 | A1 * | 10/2011 | Snyder | B41J 2/175 347/85 |
| 2014/0000719 | A1 | 1/2014 | Wright | |
| 2014/0053537 | A1 | 2/2014 | Yan et al. | |
| 2015/0252712 | A1 * | 9/2015 | Foster | F01N 3/106 137/565.17 |
| 2015/0300228 | A1 | 10/2015 | Gong et al. | |
| 2015/0300230 | A1 | 10/2015 | Brueck et al. | |
| 2016/0160731 | A1 * | 6/2016 | Turbak | F01N 13/002 60/281 |
| 2021/0033017 | A1 | 2/2021 | Fell et al. | |

OTHER PUBLICATIONS

Patent Cooperation Treaty International Searching Authority; International Search Report and Written Opinion for Application No. PCT/US2024/017911 mailed Mar. 13, 2025, 21 pages.

* cited by examiner

*Primary Examiner* — Angelisa L. Hicks
(74) *Attorney, Agent, or Firm* — Merchant & Gould P.C.

(57) ABSTRACT

A method of pumping DEF (diesel exhaust fluid) in a diesel emissions control system. The method includes pumping DEF from an auxiliary DEF tank to an onboard DEF tank. The DEF is pumped from the auxiliary DEF tank to the onboard DEF tank. The fluid pathway is purged with air after pumping the DEF from the auxiliary DEF tank to the onboard DEF tank. The air is pumped (1) through the fluid pathway from the auxiliary DEF tank, or (2) into the auxiliary DEF tank.

20 Claims, 11 Drawing Sheets

EMISSIONS CONTROL SYSTEM

CROSS-REFERENCE TO RELATED APPLICATION(S)

This application claims priority to U.S. Provisional Application No. 63/451,819, filed Mar. 13, 2023, the disclosure of which is hereby incorporated by reference in its entirety.

BACKGROUND

Diesel Exhaust Fluid (DEF) is a critical component in meeting emissions standards for diesel engines and is required by regulations in many countries. The use of DEF helps reduce harmful emissions and improve air quality, while also improving the performance and longevity of diesel engines.

DEF is a solution of purified water and urea that is used to reduce the emissions of oxides of nitrogen (NOx) from diesel engines. When DEF is injected into the exhaust stream of a diesel engine, it reacts with the NOx in the exhaust gases and converts it into harmless nitrogen gas and water vapor.

The use of DEF is required by most diesel engine manufacturers in order to comply with emissions regulations, particularly in the United States and Europe. The most widely recognized emissions regulations are the Environmental Protection Agency's (EPA) Tier 4 Final and European Union's (EU) Stage V standards.

Under these regulations, all new diesel engines must meet strict emissions standards, which require the use of DEF injection technology. The amount of DEF used depends on the engine's size and emissions output, but typically ranges from 2-5% of diesel fuel consumption.

The EPA and EU regulations also specify that DEF must meet certain quality standards. DEF must be a 32.5% urea solution and must be free from impurities such as dust, metal particles, and other contaminants. DEF is typically stored in a separate tank on the vehicle or equipment and must be replenished periodically based on usage. In some systems, DEF tank on a vehicle or equipment can be refilled using an auxiliary DEF tank that is housed outside of the vehicle or equipment.

SUMMARY

In general terms, this disclosure is directed to an emissions control system. In some embodiments, and by non-limiting example, the emissions control system comprises an onboard DEF tank and an auxiliary DEF tank. Various methods of pumping DEF from the auxiliary DEF tank into the onboard DEF tank, and subsequently purging the fluid pathway with air are disclosed herein.

DETAILED DESCRIPTION

Figure 1:
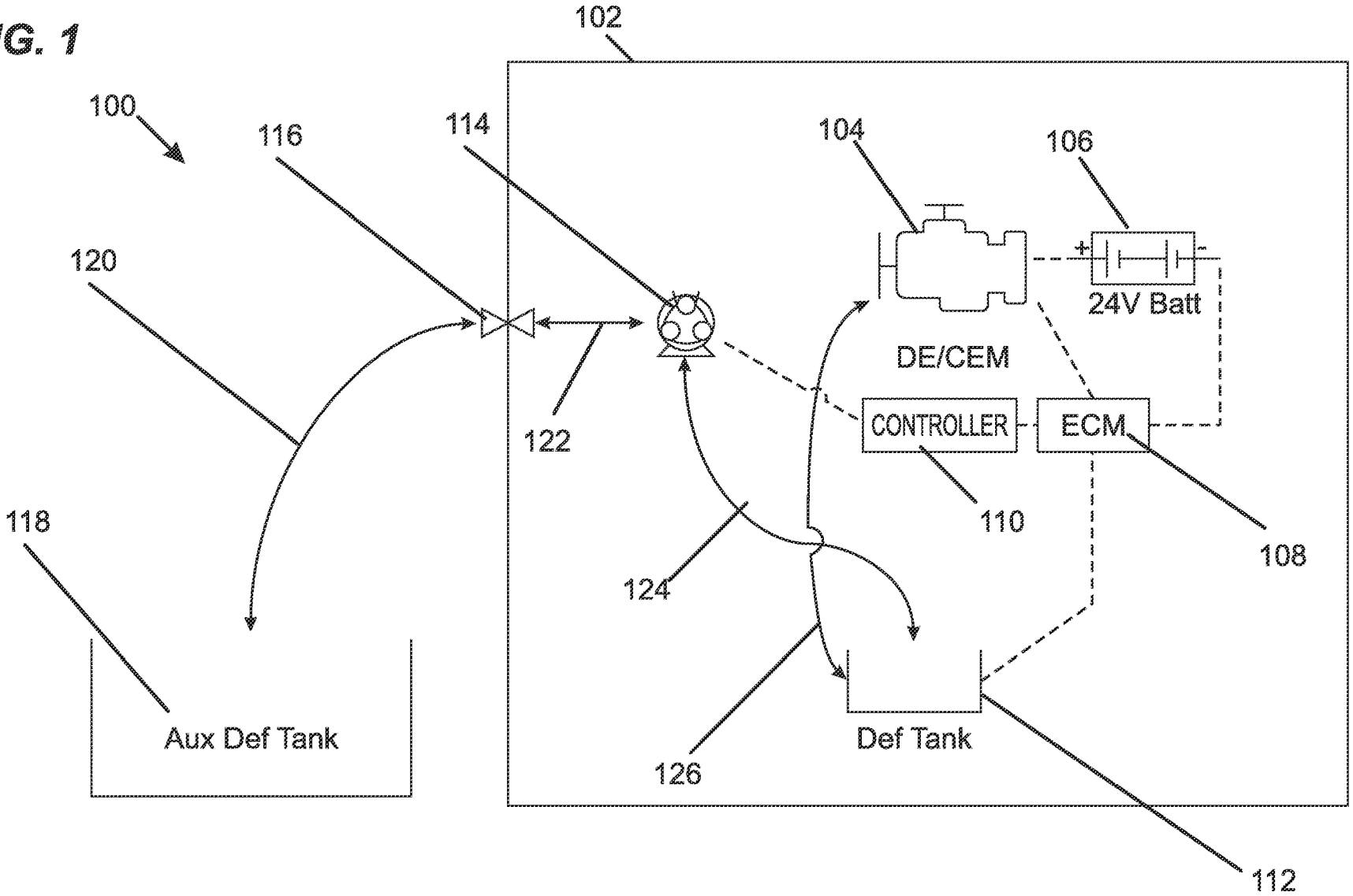
FIG. 1 is a schematic view of an example diesel emissions control system.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Auxiliary DEF fluid supply systems are used to provide an additional source of DEF for diesel engines that have high DEF consumption rates or have limited DEF tank capacity. These systems are designed to supplement the primary DEF tank on the vehicle or equipment.

Auxiliary DEF systems typically consist of a separate tank, pump, and supply lines that fluidly connect the separate tank to the primary tank on the vehicle or equipment. The pump is used to transfer the DEF fluid from the auxiliary tank to the primary DEF tank on the vehicle or equipment.

DEF is susceptible to freezing, as it contains a high percentage of water, which can cause the solution to solidify when exposed to low temperatures. Additionally, DEF can expire if it is not stored or handled properly, which can lead to a decrease in its effectiveness and potential emissions system issues. In some examples, when DEF freezes, it expands and can cause damage to the storage container, supply lines, or the vehicle's DEF injection system. To prevent freezing, DEF tanks, and supply lines are often equipped with heating systems or insulation to maintain the fluid's temperature above the freezing point. If DEF expires, it can lead to clogging or damage to the engine's DEF injection system. DEF that remains in supply lines of an auxiliary DEF system after DEF has been pumped from an auxiliary tank is particularly susceptible to these issues. This is especially the case when the auxiliary DEF system is used in extreme environments, such as environments with high or low temperatures. Therefore, improvements to auxiliary DEF supply systems that can reduce issues associated with freezing or expired DEF in supply lines of auxiliary DEF supply systems are desired.

FIG. 1 is a schematic view of an example diesel emissions control system 100. As shown in FIG. 1, the diesel emissions control system 100 includes an enclosure 102, an engine 104, a battery 106, an engine control module 108, a controller 110, an onboard DEF tank 112, a pump 114, an enclosure pass through 116, an auxiliary DEF tank 118, an external auxiliary DEF line 120, an first internal auxiliary DEF line 122, a second internal auxiliary DEF line 124, and an engine DEF supply line 126. While FIG. 1 illustrates one auxiliary DEF tank 118 and one onboard DEF tank 112, in some examples, multiple auxiliary DEF tanks and multiple onboard DEF tanks are used. In some examples, the diesel emissions control system 100 is installed in a generator. In some examples, some or all of the components of the diesel emissions control system 100 are heated by heating elements (not pictured).

As shown in the example of FIG. 1, the enclosure 102 houses the engine 104, battery 106, engine control module 108, controller 110, onboard DEF tank 112, pump 114, first internal auxiliary DEF line 122, second internal auxiliary DEF line 124, and the engine DEF supply line 126. In the example of FIG. 1, the enclosure pass through 116 is formed within a wall of the enclosure 102. In the example of FIG. 1, the auxiliary DEF tank 118 and the external auxiliary DEF line 120 are arranged outside of the enclosure 102.

The engine 104 comprises a diesel engine. In some examples, the engine 104 further comprises an after treatment system. In some examples, the after treatment system includes a DEF exhaust module which is configured to deliver DEF into an exhaust system of the engine 104.

The battery 106 is connected to the engine (specifically the engine exhaust module) by an electrical connection. In some examples, the battery 106 is a single 24V battery. In other examples, the battery 106 is a single 12V battery. In other examples, the battery 106 comprises multiple 24V batteries. In other examples, the battery comprises multiple 12V batteries.

The engine control module 108 is connected to the battery 106 by an electrical connection. The engine control module 108 reads values from sensors, interprets the data from the sensors, and communicates signals to other parts of the diesel emissions control system 100. In some examples, the engine control module 108 is electrically connected to and sends and/or receives signals to/from the controller 110, the engine 104, and the onboard DEF tank 112.

The controller 110 is connected to the engine control module 108 by an electrical connection. The controller 110 communicates signals from the engine control module 108 to other components of the diesel emissions control system 100. In the example illustrated in FIG. 1, the controller 110 communicates signals to the pump 114.

The pump 114 is connected to the controller 110 by an electrical connection. In some examples, the controller 110 controls the operation of the pump 114. In some examples, the pump 114 is a reversible pump. In some examples, the pump 114 is a reversible peristaltic pump. In some examples, the controller 110 controls both the operational status of the pump (whether the pump is on or off) as well as the directionality of the pump (whether the pump is pumping from first internal auxiliary DEF line 122 to second internal auxiliary DEF line 124 or from second internal auxiliary DEF line 124 to first internal auxiliary DEF line 122.

As shown in FIG. 1, the pump 114 is fluidly connected to the first internal auxiliary DEF line 122. The first internal auxiliary DEF line 122 connects the pump to the enclosure pass through 116. The enclosure pass through fluidly connects the first internal auxiliary DEF line 122 to the external auxiliary DEF line 120. The external auxiliary DEF line 120 is fluidly connected to the auxiliary DEF tank 118.

The pump 114 is also fluidly connected to the second internal auxiliary DEF line 124. The second internal auxiliary DEF line 124 is fluidly connected to the onboard DEF tank 112.

The onboard DEF tank 112 is fluidly connected to the engine DEF supply line 126, which is fluidly connected to the engine 104. In some examples, the engine 104 is able to draw DEF from the onboard DEF tank 112 through the engine DEF supply line 126 such that the DEF can be used in the after treatment system of the of the engine 104.

Figure 2:
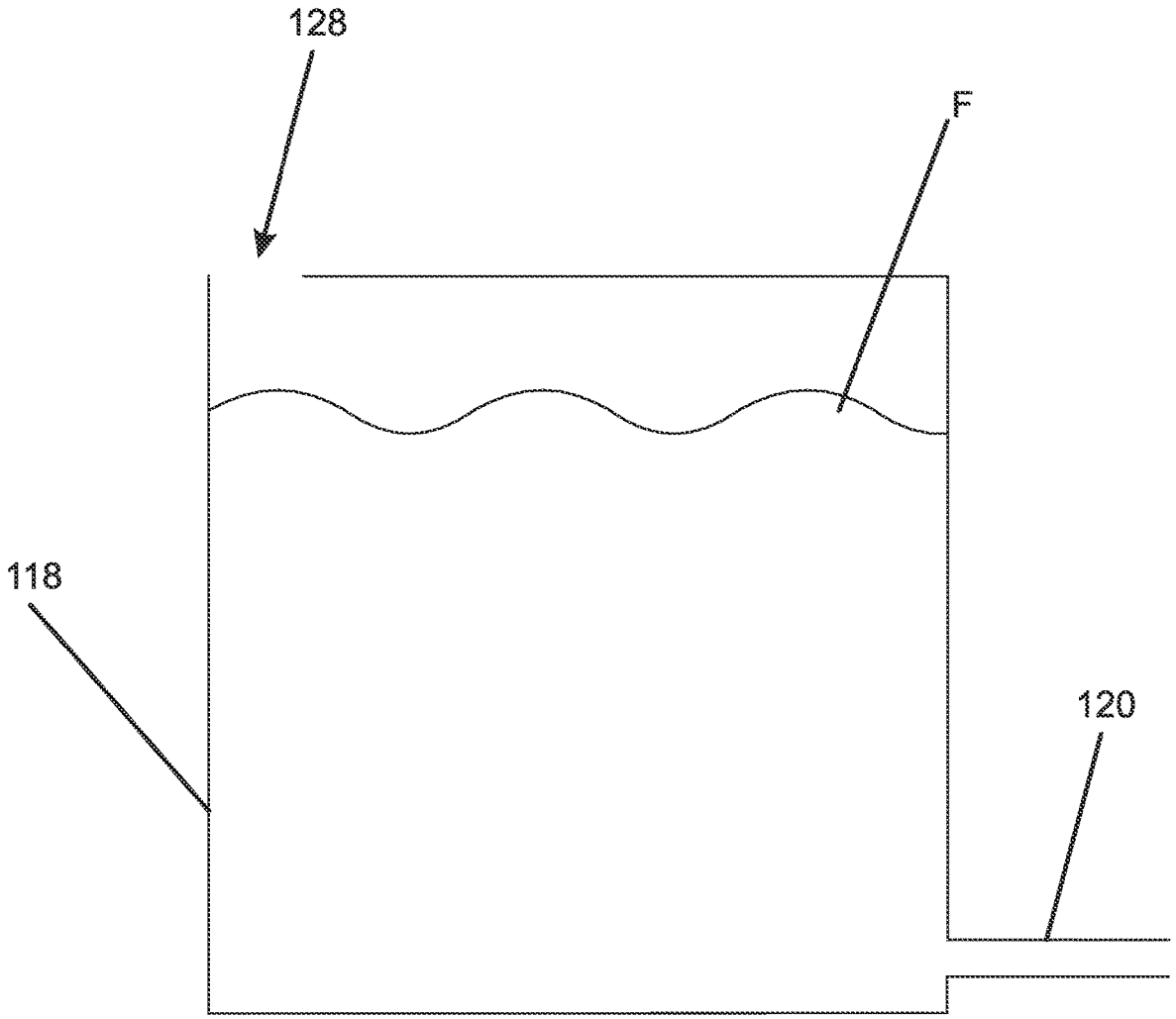
FIG. 2 is a schematic view of an example auxiliary DEF tank of the diesel emissions control system of FIG. 1.

FIG. 2 is a schematic view of the auxiliary DEF tank 118, which houses DEF fluid F. The auxiliary DEF tank 118 includes a vent 128 to allow airflow into and out of the auxiliary DEF tank 118. In some examples, the auxiliary DEF tank 118 is fluidly connected to the external auxiliary DEF line 120 at the bottom side of the auxiliary DEF tank 118. In some examples, the external auxiliary DEF line 120 is connected to the auxiliary DEF tank 118 at a point below the level of the DEF fluid F when the auxiliary DEF tank 118 has DEF therein. In some examples, the auxiliary DEF tank 118 and/or the external auxiliary DEF line 120 are heated by heating elements (not pictured).

Figure 3:
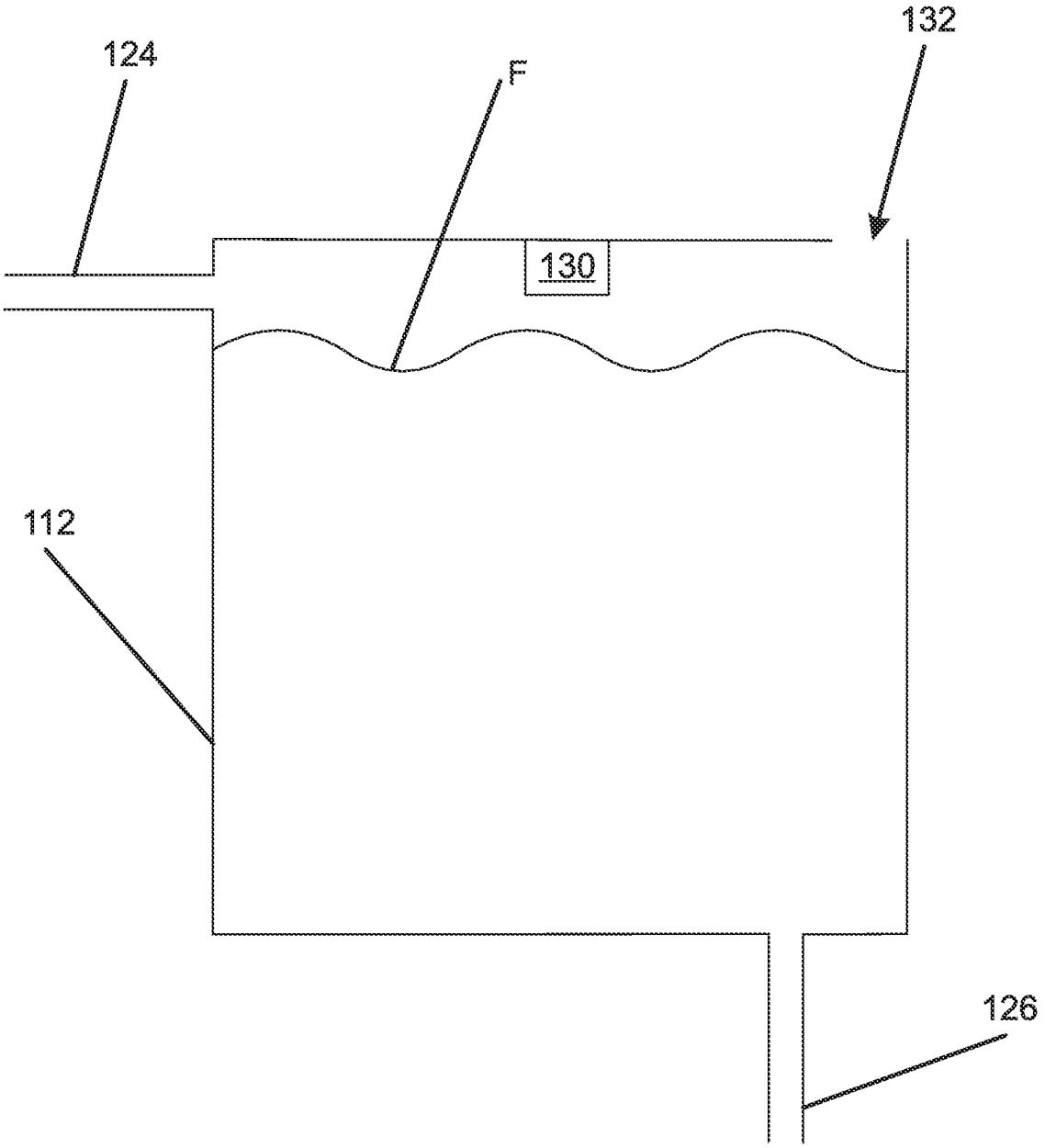
FIG. 3 is a schematic view of an example onboard DEF tank of the diesel emissions control system of FIG. 1.

FIG. 3 is a schematic view of the onboard DEF tank 112, which houses DEF fluid F. In some examples, the onboard DEF tank 112 includes a vent 132 and a fluid level sensor 130. The vent 132 allows airflow into and out of the onboard DEF tank 112. In some examples, the vent 132 is arranged at a top side of the onboard DEF tank 112 above the surface of the DEF fluid F within the onboard DEF tank 112. In some examples, the onboard DEF tank 112 further includes a fluid level sensor 130. In some examples, the fluid level sensor is electrically connected to the engine control module 108. In some examples, the fluid sensor is any one of a variety of different examples of fluid level sensors, such as, for example, a glass level gauge, a float, a displacer, a bubbler, a differential pressure transmitter, a load cell, a magnetic level gauge, a capacitance transmitter, a magnetostrictive level transmitter, an ultrasonic level transmitter, a laser level transmitter, or a radar level transmitter. In some examples, the onboard DEF tank 112 is connected to the second internal auxiliary DEF line 124. In some examples, the second internal auxiliary DEF line 124 is connected to the onboard DEF tank 112 at a top side of the onboard DEF tank. In some examples, the onboard DEF tank 112 is configured such that the second internal auxiliary DEF line 124 is connected to the onboard DEF tank at a point above the level of the DEF fluid when the onboard DEF tank 112 has DEF therein. In some examples, the onboard DEF tank 112 is further connected to the engine DEF supply line 126. In some examples, the engine DEF supply line is 126 connected to the onboard DEF tank 112 at a bottom side of the onboard DEF tank 112. In some examples, the onboard DEF tank 112 is configured such that the engine DEF supply line is 126 is connected to the onboard DEF tank at a point below the level of the DEF fluid when the onboard DEF tank 112 has DEF therein. In some examples, the onboard DEF tank 112, the second internal auxiliary DEF line 124 and/or the first internal auxiliary DEF line 122 are heated by heating elements (not pictured).

Figure 4:
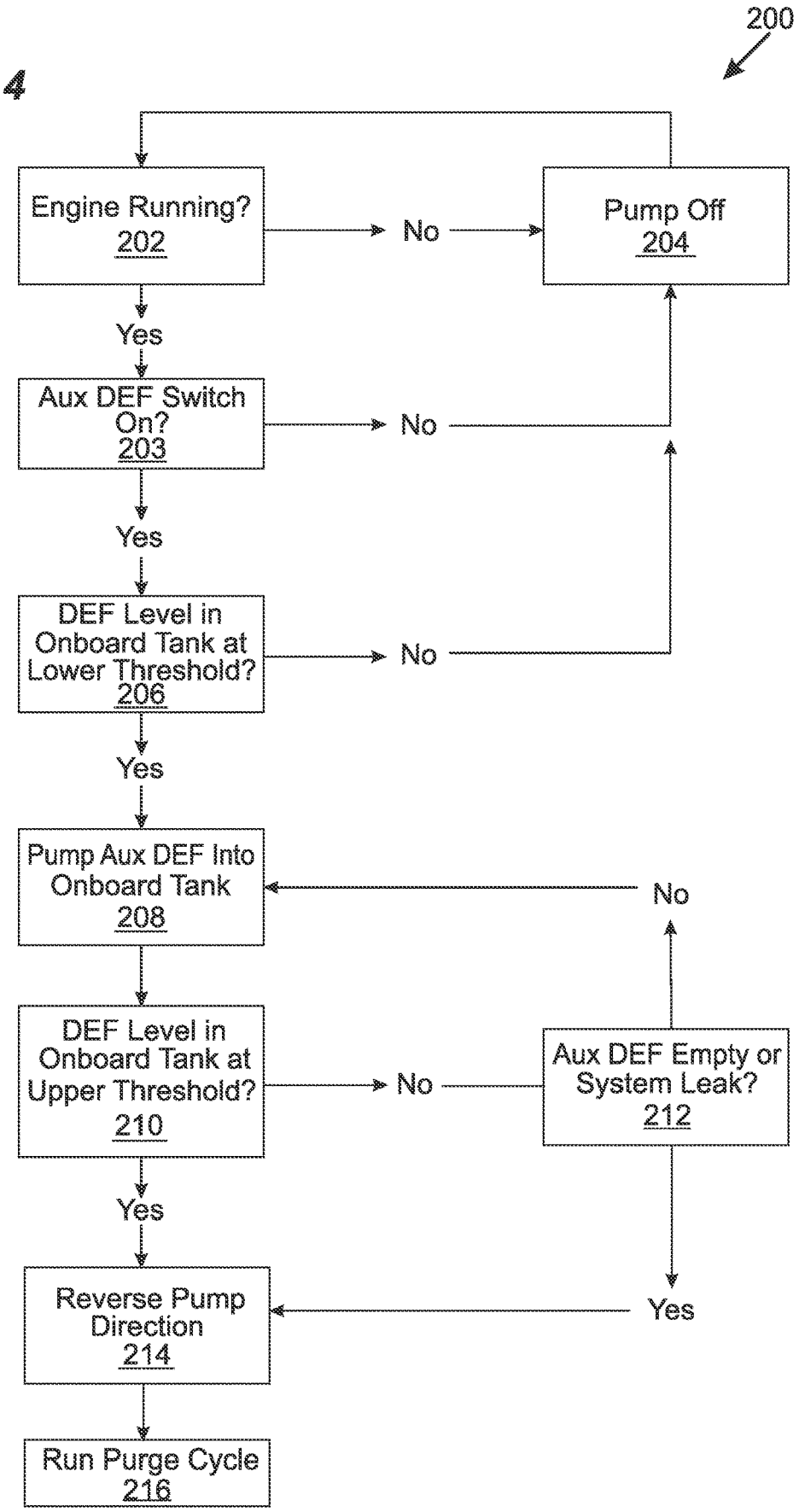
FIG. 4 is a flowchart of an example method of using a diesel emissions control system.

FIG. 4 is a flowchart of a method 200 of using a diesel emissions control system, such as the diesel emissions control system 100. The method 200 includes operations 202, 203, 204, 206, 208, 210, 212, 214, and 216.

Operation 202 includes checking whether the engine is running. In some examples, operation 202 is performed by the controller 110 to determine whether the engine 104 is running. If, in operation 202, it is determined that the engine is not running, operation 204 is performed. If, in operation 202, it is determined that the engine is running, operation 203 is performed.

Operation 204 includes turning off the pump. In some examples, operation 204 is performed by the engine control module 108 communicating a signal to the controller 110 which results in the controller 110 cutting off power to the pump 114 to turn off the pump 114. In some examples after operation 204 is complete, operation 202 is performed.

Operation 203 includes determining whether an auxiliary DEF tank switch is on. In some examples, the auxiliary DEF switch is included in the diesel emissions control system 100 and is selectively adjustable by a user. In some examples, the auxiliary DEF switch is selectively adjustable between an "on" and an "off" position. In some examples, the auxiliary DEF switch is placed into the "on" position when the auxiliary DEF tank 118 is connected to the diesel emissions control system 100. In some examples, the auxiliary DEF switch is placed into the "off" position when the auxiliary DEF tank 118 is not connected to the diesel emissions control system 100. In some examples, the position of the auxiliary DEF switch is adjusted automatically by the diesel emissions control system 100 based on whether the presence of the auxiliary DEF tank 118 is detected. In other examples, the auxiliary DEF switch is adjusted by a user based on whether the user has connected the auxiliary DEF tank 118 to the diesel emissions control system. In some examples, operation 203 is performed before operation 202. In other examples, as illustrated in FIG. 4, operation 203 is performed after operation 202. If, in operation 203, it is determined that the auxiliary DEF switch is not on, operation 204 is performed. If, in operation 203, it is determined that the auxiliary DEF switch is on, operation 206 is performed.

Operation 206 includes determining whether the fluid level of DEF in an onboard DEF tank is at or below a lower threshold. In some examples, operation 206 is performed by the controller 110 to determine whether the fluid level of DEF in the onboard DEF tank 112 is at or below a lower threshold. In some examples, the lower threshold is about 20% of the capacity of the onboard DEF tank 112 (such as, for example, 20% of the capacity of the onboard DEF tank 112). In other examples, the lower threshold is about 30% of the capacity of the onboard DEF tank 112 (such as, for example, 30% of the capacity of the onboard DEF tank 112). In some examples, the lower threshold is any value between about 0% to about 30% of the capacity of the onboard DEF tank 112 (such as, for example, any value between 0% and 30% of the capacity of the onboard DEF tank 112). In some examples, the engine control module 108 performs operation 206 by receiving a signal from the fluid level sensor 130 in the onboard DEF tank 112 indicative of the fluid level of DEF in the onboard DEF tank 112. In some examples, if, in operation 206, it is determined that the fluid level of DEF in an onboard DEF tank is not at or below the lower threshold, operation 204 is performed. If, in operation 206, it is determined that the fluid level of DEF in an onboard DEF tank is at or below the lower threshold, operation 208 is performed.

Operation 208 includes pumping DEF from an auxiliary DEF tank into an onboard DEF tank. In some examples, operation 208 is performed by the pump 114 to pump DEF in a first direction from the auxiliary DEF tank 118 through the external auxiliary DEF line 120, the enclosure pass through 116, the first internal auxiliary DEF line 122, the pump 114, and the second internal auxiliary DEF line 124 into the onboard DEF tank 112. In some examples, operation 208 is initiated by the engine control module 108 providing a signal to the controller 110 and the controller 110 providing power to the pump 114 which causes the pump 114 to pump DEF in the first direction. In some examples, operation 208 includes pumping a predetermined amount of DEF from an auxiliary DEF tank by performing a predetermined number of pump cycles or by operating the pump for a predetermined amount of time. In other examples, operation 208 is performed indefinitely until the pump 114 is interrupted.

Operation 210 includes determining whether the fluid level of DEF in an onboard DEF tank is at or above an upper threshold. In some examples, operation 210 is performed simultaneously with operation 208. In other examples, operation 210 is performed sequentially after operation 208. In some examples, operation 210 is performed by the controller 110 to determine whether the fluid level of DEF in the onboard DEF tank 112 is at or above an upper threshold. In some examples, the upper threshold is 80% of the capacity of the onboard DEF tank 112. In some examples, the upper threshold is about 80% of the capacity of the onboard DEF tank 112 (such as, for example, 80% of the capacity of the onboard DEF tank 112). In other examples, the upper threshold is about 70% of the capacity of the onboard DEF tank 112 (such as, for example, 70% of the capacity of the onboard DEF tank 112). In some examples, the upper threshold is any value between about 70% to about 100% of the capacity of the onboard DEF tank 112 (such as, for example, any value between 70% and 100% of the capacity of the onboard DEF tank 112). In some examples, the engine control module 108 performs operation 210 by receiving a signal from the fluid level sensor 130 in the onboard DEF tank 112 indicative of the fluid level of DEF in the onboard DEF tank 112. In some examples, if, in operation 210, it is determined that the fluid level of DEF in an onboard DEF tank is not at or above the upper threshold, operation 212 is performed. If, in operation 210, it is determined that the fluid level of DEF in an onboard DEF tank is at or above the upper threshold, operation 214 is performed.

Operation 212 includes determining whether the auxiliary DEF tank is empty or that there is a system leak. In some examples, operation 212 is performed by the engine control module 108 to determine whether the auxiliary DEF tank 118 is empty or that there is a system leak. In some examples, the determination of whether the auxiliary DEF tank 118 is empty is made by directly measuring the DEF level in the auxiliary DEF tank 118 using a fluid level sensor.

In other examples, in operation 212, the determination of whether the auxiliary DEF tank 118 is empty or that there is a system leak is made by monitoring the DEF level in the onboard DEF tank 112 over time. In such examples, the engine control module 108 receives signals from the fluid level sensor 130 indicative of the DEF level in the onboard DEF tank 112 and uses the signals to make a determination of whether the auxiliary DEF tank 118 is empty or that there is a system leak. In some examples, operation 212 is performed simultaneously with operation 208. In such examples, in operation 212, the DEF level of the onboard DEF tank 112 is monitored while the pump is pumping in the first direction over a period of time. If the DEF level of the onboard DEF tank 112 increases a predetermined amount over the period of time, then a determination is made that the auxiliary DEF tank 118 is not empty. If, however, the DEF level of the onboard DEF tank 112 does not increase a predetermined amount over the period of time, then a determination is made that the auxiliary DEF tank 118 is empty or that there is a system leak and operation 214 is performed.

In some examples, if, in operation 212, it is determined that the auxiliary DEF tank 118 is empty or that there is a system leak, an error message is generated to notify a user that the auxiliary DEF tank 118 is empty or that there is a system leak.

In some examples, each of operations 210 and 212 are performed simultaneously with operation 208. such that if, in operation 210, it is determined that the fluid level of DEF in an onboard DEF tank is not at or above the upper threshold and in operation 212, it is determined that the auxiliary DEF tank 118 is not empty, then operation 208 is continued. In some examples, operations 210 and 212 are performed multiple times while operation 208 is performed.

Operation 214 includes reversing the direction of the pump. In some examples, operation 214 is performed by the engine control module 108 communicating a signal to the controller 110. The controller 110 reverses the polarity of the power to the pump 114, which causes the pump 114 to pump in a second direction. In some examples, pumping in the second direction includes pumping from the onboard DEF tank 112, through the second internal auxiliary DEF line 124, through the pump 114, the first internal auxiliary DEF line 122, the enclosure pass through 116, the external auxiliary DEF line 120, and into the auxiliary DEF tank 118. In some examples, after performing operation 214, operation 216 is performed.

Operation 216 includes running a purge cycle. In some examples, running a purge cycle includes pumping from a unit DEF tank into an auxiliary DEF tank. In some examples, operation 216 is performed by the pump 114 pumping air in the second direction, described with respect to operation 214. In some examples, operation 216 is performed for a sufficient amount of time to pump a sufficient amount of air so as to completely purge the second internal auxiliary DEF line 124, the pump 114, the first internal auxiliary DEF line 122, the enclosure pass through 116, and the external auxiliary DEF line 120 such that all of the DEF is removed from the components and replaced with air. In some examples, operation 216 is initiated by the engine control module 108 providing a signal to the controller 110 and the controller 110 providing reversed polarity power to the pump 114 which causes the pump 114 to pump in the second direction.

Referring back to FIG. 3, in some examples, when operation 216 is performed and the pump 114 is operated to pump in the second direction, the pump 114 draws from the onboard DEF tank 112 through the second internal auxiliary DEF line 124. In some examples, because the second internal auxiliary DEF line 124 is connected to the onboard DEF tank 112 at a point above the fluid level of the DEF in the onboard DEF tank 112, when the pump 114 draws air from vent 132 which flows through the onboard DEF tank 112. Thus, when operation 216 is performed, air flows from the vent 132, through the onboard DEF tank 112, the second internal auxiliary DEF line 124, the pump 114, the first internal auxiliary DEF line 122, the enclosure pass through 116, the external auxiliary DEF line 120, into the auxiliary DEF tank 118 and out the vent 128. In some examples, by pumping air in the second direction, the pump causes the DEF in the second internal auxiliary DEF line 124, the pump 114, the first internal auxiliary DEF line 122, the enclosure pass through 116, the external auxiliary DEF line 120 to flow out of the second internal auxiliary DEF line 124, the pump 114, the first internal auxiliary DEF line 122, the enclosure pass through 116, the external auxiliary DEF line 120 and back into the auxiliary DEF tank 118.

Figure 5:
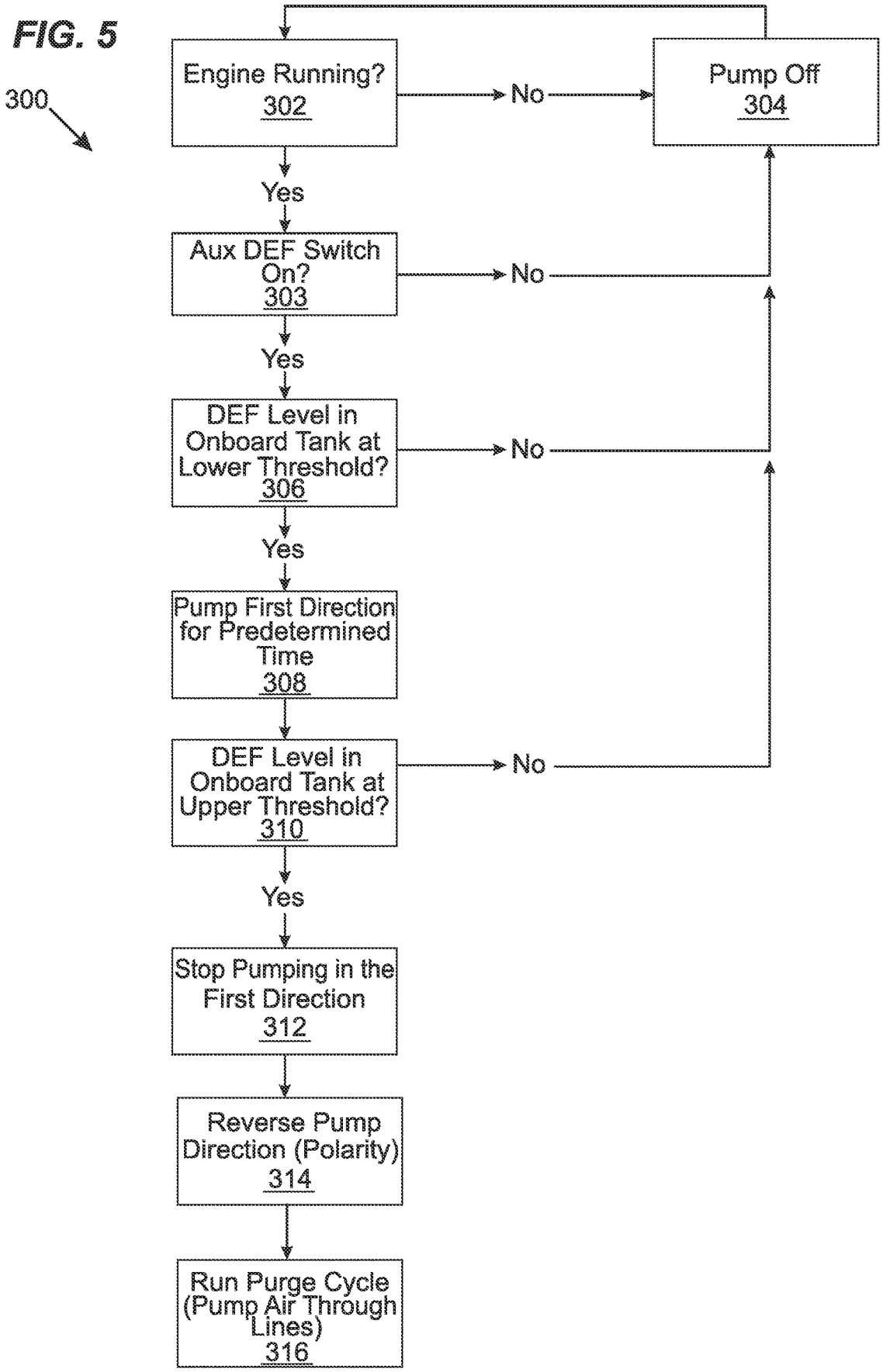
FIG. 5 is a flowchart of another example method of using a diesel emissions control system.

FIG. 5 is a flowchart of an alternative method 300 of using a diesel emissions control system, such as the diesel emissions control system 100. The method 300 includes operations 302, 303, 304, 306, 308, 310, 312, 314, and 316.

Operation 302 includes checking whether the engine is running. In some examples, operation 302 is performed by the controller 110 to determine whether the engine 104 is running. If, in operation 302, it is determined that the engine is not running, operation 304 is performed. If, in operation 302, it is determined that the engine is running, operation 303 is performed.

Operation 304 includes turning off the pump. In some examples, operation 304 is performed by the engine control module 108 communicating a signal to the controller 110 which results in the controller 110 cutting off power to the pump 114 to turn off the pump 114. In some examples after operation 304 is complete, operation 302 is performed.

Operation 303 includes determining whether an auxiliary DEF tank switch is on. In some examples, the auxiliary DEF switch is included in the diesel emissions control system 100 and is selectively adjustable by a user. In some examples, the auxiliary DEF switch is selectively adjustable between an "on" and an "off" position. In some examples, the auxiliary DEF switch is placed into the "on" position when the auxiliary DEF tank 118 is connected to the diesel emissions control system 100. In some examples, the auxiliary DEF switch is placed into the "off" position when the auxiliary DEF tank 118 is not connected to the diesel emissions control system 100. In some examples, the position of the auxiliary DEF switch is adjusted automatically by the diesel emissions control system 100 based on whether the presence of the auxiliary DEF tank 118 is detected. In other examples, the auxiliary DEF switch is adjusted by a user based on whether the user has connected the auxiliary DEF tank 118 to the diesel emissions control system. In some examples, operation 303 is performed before operation 302. In other examples, as illustrated in FIG. 5, operation 303 is performed after operation 302. If, in operation 303, it is determined that the auxiliary DEF switch is not on, operation 304 is performed. If, in operation 303, it is determined that the auxiliary DEF switch is on, operation 306 is performed.

Operation 306 includes determining whether the fluid level of DEF in an onboard DEF tank is at or below a lower threshold. In some examples, operation 306 is performed by the controller 110 to determine whether the fluid level of DEF in the onboard DEF tank 112 is at or below a lower threshold. In some examples, the lower threshold is about 20% of the capacity of the onboard DEF tank 112 (such as, for example, 20% of the capacity of the onboard DEF tank 112). In other examples, the lower threshold is about 30% of the capacity of the onboard DEF tank 112 (such as, for example, 30% of the capacity of the onboard DEF tank 112). In some examples, the lower threshold is any value between about 0% to about 30% of the capacity of the onboard DEF tank 112 (such as, for example, any value between 0% and 30% of the capacity of the onboard DEF tank 112). In some examples, the engine control module 108 performs operation 306 by receiving a signal from the fluid level sensor 130 in the onboard DEF tank 112 indicative of the fluid level of DEF in the onboard DEF tank 112. In some examples, if, in operation 306, it is determined that the fluid level of DEF in an onboard DEF tank is not at or below the lower threshold, operation 304 is performed. If, in operation 306, it is determined that the fluid level of DEF in an onboard DEF tank is at or below the lower threshold, operation 308 is performed.

Operation 308 includes pumping in a first direction for a predetermined time. In some examples, operation 308 is performed by the pump 114 to pump DEF in a first direction from the auxiliary DEF tank 118 through the external auxiliary DEF line 120, the enclosure pass through 116, the first internal auxiliary DEF line 122, the pump 114, and the second internal auxiliary DEF line 124 into the onboard DEF tank 112. In some examples, operation 308 is initiated by the engine control module 108 providing a signal to the controller 110 and the controller 110 providing power to the pump 114 which causes the pump 114 to pump DEF in the first direction. In some examples, the predetermined time is the sum of two time intervals, the first time interval being the amount of time that it takes to fill the onboard DEF tank 112 from the lower threshold to the upper threshold, and the second interval being the amount of time that it takes to completely purge the external auxiliary DEF line 120, the enclosure pass through 116, the first internal auxiliary DEF line 122, the pump 114, and the second internal auxiliary DEF line 124 with air. In some examples, the predetermined amount of time is only the first time interval.

Operation 310 includes determining whether the fluid level of DEF in an onboard DEF tank is at or above an upper threshold. In some examples, operations 310 and 312 are performed simultaneously with operation 308. In some examples, operation 310 is performed by the controller 110 to determine whether the fluid level of DEF in the onboard DEF tank 112 is at or above an upper threshold. In some examples, the upper threshold is about 80% of the capacity of the onboard DEF tank 112 (such as, for example, 80% of the capacity of the onboard DEF tank 112). In other examples, the upper threshold is about 70% of the capacity of the onboard DEF tank 112 (such as, for example, 70% of the capacity of the onboard DEF tank 112). In some examples, the upper threshold is any value between about 70% to about 100% of the capacity of the onboard DEF tank 112 (such as, for example, any value between 70% and 100% of the capacity of the onboard DEF tank 112). In some examples, the engine control module 108 performs operation 310 by receiving a signal from the fluid level sensor 130 in the onboard DEF tank 112 indicative of the fluid level of DEF in the onboard DEF tank 112. In some examples, if, in operation 310, it is determined that the predetermined amount of time has elapsed and that the fluid level of DEF in the onboard DEF tank 112 is not at or above the upper threshold, operation 304 is performed. If, in operation 310, it is determined that the fluid level of DEF in an onboard DEF tank is at or above the upper threshold, operation 312 is performed.

Operation 312 includes interrupting operation 308 to stop the pump from pumping in the first direction. In some examples, operation 312 is performed by the engine control module 108 communicating a signal to the controller 110. The controller 110 cuts off power to the pump 114, which causes the pump 114 to stop pumping in the first direction. In some examples, operation 312 causes to pump 114 to stop pumping before the predetermined time has elapsed. In some examples, operation 314 is performed after operation 312.

Operation 314 includes reversing the direction of the pump. In some examples, operation 314 is performed by the engine control module 108 communicating a signal to the controller 110. The controller 110 reverses the polarity of the power to the pump 114, which causes the pump 114 to pump in a second direction. In some examples, pumping in the second direction includes pumping from the onboard DEF tank 112, through the second internal auxiliary DEF line 124, through the pump 114, the first internal auxiliary DEF line 122, the enclosure pass through 116, the external auxiliary DEF line 120, and into the auxiliary DEF tank 118. In some examples, after performing operation 314, operation 316 is performed.

Operation 316 includes running a purge cycle. In some examples, running a purge cycle includes pumping from a unit DEF tank into an auxiliary DEF tank. In some examples, operation 316 is performed by the pump 114 pumping air in the second direction, described with respect to operation 314. In some examples, operation 316 is performed for a sufficient amount of time to pump a sufficient amount of air so as to completely purge the second internal auxiliary DEF line 124, the pump 114, the first internal auxiliary DEF line 122, the enclosure pass through 116, and the external auxiliary DEF line 120 such that all of the DEF is removed from the components and replaced with air. In some examples, operation 316 is initiated by the engine control module 108 providing a signal to the controller 110 and the controller 110 providing reversed polarity power to the pump 114 which causes the pump 114 to pump in the second direction.

In some examples, the method 300 is performed without operation 310, in which case operation 312 is performed after operation 308 is completed.

Figure 6:
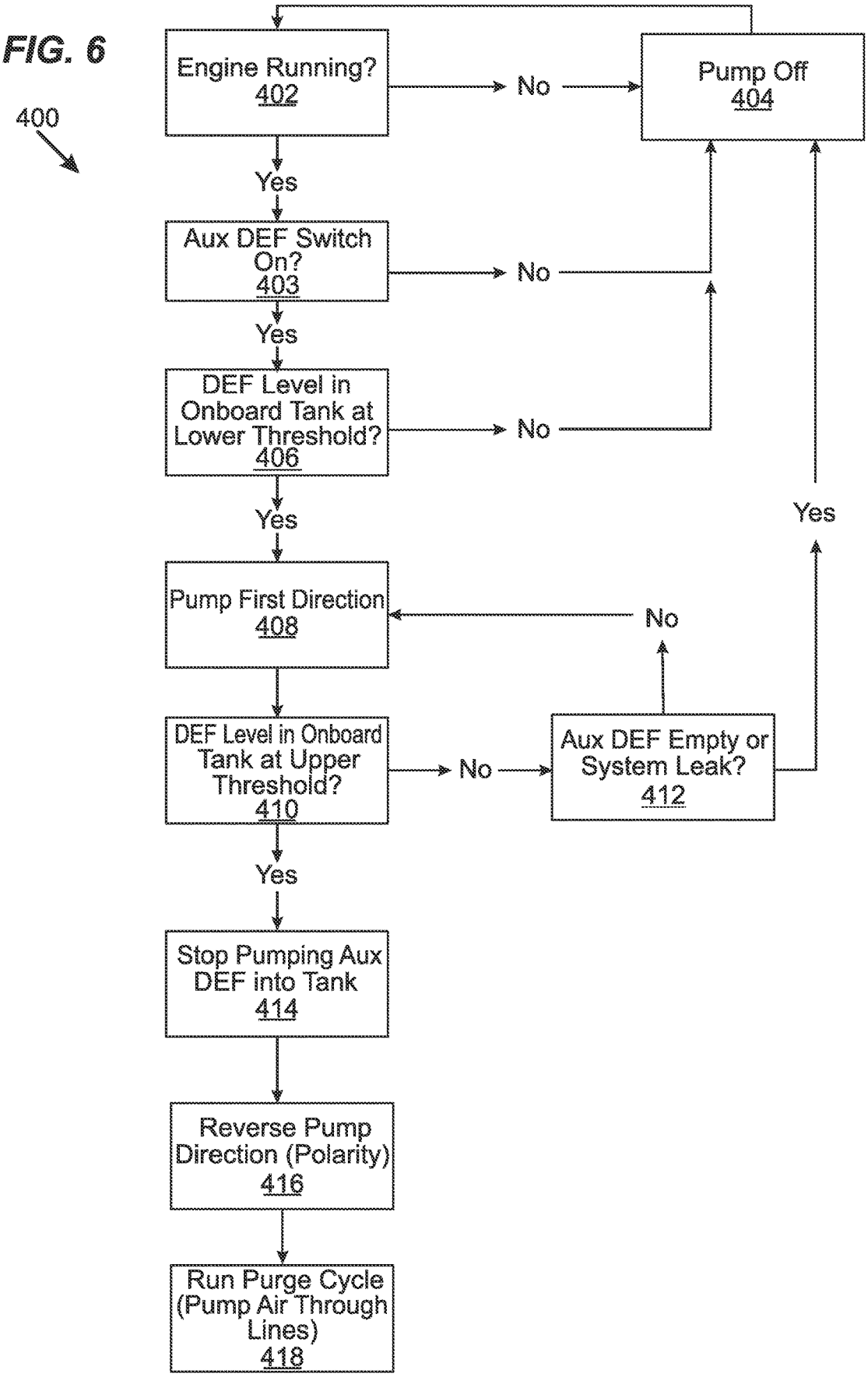
FIG. 6 is a flowchart of another example method of using a diesel emissions control system.

FIG. 6 is a flowchart of another alternative method 400 of using a diesel emissions control system, such as the diesel emissions control system 100. The method 400 includes operations 402, 403, 404, 406, 408, 410, 412, 414, and 418.

Operations 402-406 are performed in a substantially similar manner to operations 302-306 in FIGS. 5 and 202-206 in FIG. 4. If, in operation 406, it is determined that the fluid level of DEF in an onboard DEF tank is at or below the lower threshold, operation 408 is performed.

Operation 408 includes pumping in a first direction. In some examples, operation 408 is performed by the pump 114 to pump DEF in a first direction from the auxiliary DEF tank 118 through the external auxiliary DEF line 120, the enclosure pass through 116, the first internal auxiliary DEF line 122, the pump 114, and the second internal auxiliary DEF line 124 into the onboard DEF tank 112. In some examples, operation 308 is initiated by the engine control module 108 providing a signal to the controller 110 and the controller 110 providing power to the pump 114 which causes the pump 114 to pump DEF in the first direction. In some examples, operation 408 is performed indefinitely.

Operation 410 includes determining whether the fluid level of DEF in an onboard DEF tank is at or above an upper threshold. In some examples, operation 410 is performed simultaneously with operation 408. In some examples, operation 410 is performed by the controller 110 to determine whether the fluid level of DEF in the onboard DEF tank 112 is at or above an upper threshold. In some examples, the upper threshold is about 80% of the capacity of the onboard DEF tank 112 (such as, for example, 80% of the capacity of the onboard DEF tank 112). In other examples, the upper threshold is about 70% of the capacity of the onboard DEF tank 112 (such as, for example, 70% of the capacity of the onboard DEF tank 112). In some examples, the upper threshold is any value between about 70% to about 100% of the capacity of the onboard DEF tank 112 (such as, for example, any value between 70% and 100% of the capacity of the onboard DEF tank 112). In some examples, the engine control module 108 performs operation 410 by receiving a signal from the fluid level sensor 130 in the onboard DEF tank 112 indicative of the fluid level of DEF in the onboard DEF tank 112. In some examples, if, in operation 410, it is determined that the fluid level of DEF in the onboard DEF tank 112 is not at or above the upper threshold, operation 412 is performed. If, in operation 410, it is determined that the fluid level of DEF in an onboard DEF tank is at or above the upper threshold, operation 414 is performed.

Operation 412 includes determining whether the auxiliary DEF tank is empty or that there is a system leak. In some examples, operation 412 is performed by the engine control module 108 to determine whether the auxiliary DEF tank 118 is empty or that there is a system leak. In some examples, in operation 412, the determination of whether the auxiliary DEF tank 118 is empty or that there is a system leak is made by monitoring the DEF level in the onboard DEF tank 112 over time. In such examples, the engine control module 108 receives signals from the fluid level sensor 130 indicative of the DEF level in the onboard DEF tank 112 and uses the signals to make a determination of whether the auxiliary DEF tank 118 is empty or that there is a system leak. In some examples, operation 412 is performed simultaneously with operation 408. In such examples, in operation 412, the DEF level of the onboard DEF tank 112 is monitored while the pump is pumping in the first direction over a period of time. If the DEF level of the onboard DEF tank 112 increases over the period of time, then a determination is made that the auxiliary DEF tank 118 is not empty. If, however, the DEF level of the onboard DEF tank 112 does not increase over the period of time, then a determination is made that the auxiliary DEF tank 118 is empty or that there is a system leak and operation 404 is performed. In some examples, the predetermined time is the amount of time that it takes to pump a sufficient amount of air so as to completely purge the second internal auxiliary DEF line 124, the pump 114, the first internal auxiliary DEF line 122, the enclosure pass through 116, and the external auxiliary DEF line 120 such that all of the DEF is removed from the components and replaced with air.

In some examples, if, in operation 412, it is determined that the auxiliary DEF tank 118 is empty or that there is a system leak, an error message is generated to notify a user that the auxiliary DEF tank 118 is empty or that there is a system leak.

In some examples, each of operations 410 and 412 are performed simultaneously with operation 408. such that if, in operation 410, it is determined that the fluid level of DEF in an onboard DEF tank is not at or above the upper threshold and in operation 412, it is determined that the auxiliary DEF tank 118 is not empty, then operation 408 is continued. In some examples, operations 410 and 412 are performed multiple times while operation 408 is performed.

Operation 414 includes interrupting operation 408 to stop the pump from pumping in the first direction. In some examples, operation 414 is performed by the engine control module 108 communicating a signal to the controller 110. The controller 110 cuts off power to the pump 114, which causes the pump 114 to stop pumping in the first direction. In some examples, operation 416 is performed after operation 414.

Operation 416 includes reversing the direction of the pump. In some examples, operation 416 is performed by the engine control module 108 communicating a signal to the controller 110. The controller 110 reverses the polarity of the power to the pump 114, which causes the pump 114 to pump in a second direction. In some examples, pumping in the second direction includes pumping from the onboard DEF tank 112, through the second internal auxiliary DEF line 124, through the pump 114, the first internal auxiliary DEF line 122, the enclosure pass through 116, the external auxiliary DEF line 120, and into the auxiliary DEF tank 118. In some examples, after performing operation 416, operation 418 is performed.

Operation 418 includes running a purge cycle. In some examples, running a purge cycle includes pumping from a unit DEF tank into an auxiliary DEF tank. In some examples, operation 418 is performed by the pump 114 pumping air in the second direction, described with respect to operation 416. In some examples, operation 418 is performed for a sufficient amount of time to pump a sufficient amount of air so as to completely purge the second internal auxiliary DEF line 124, the pump 114, the first internal auxiliary DEF line 122, the enclosure pass through 116, and the external auxiliary DEF line 120 such that all of the DEF is removed from the components and replaced with air. In some examples, operation 418 is initiated by the engine control module 108 providing a signal to the controller 110 and the controller 110 providing reversed polarity power to the pump 114 which causes the pump 114 to pump in the second direction.

Figure 7:
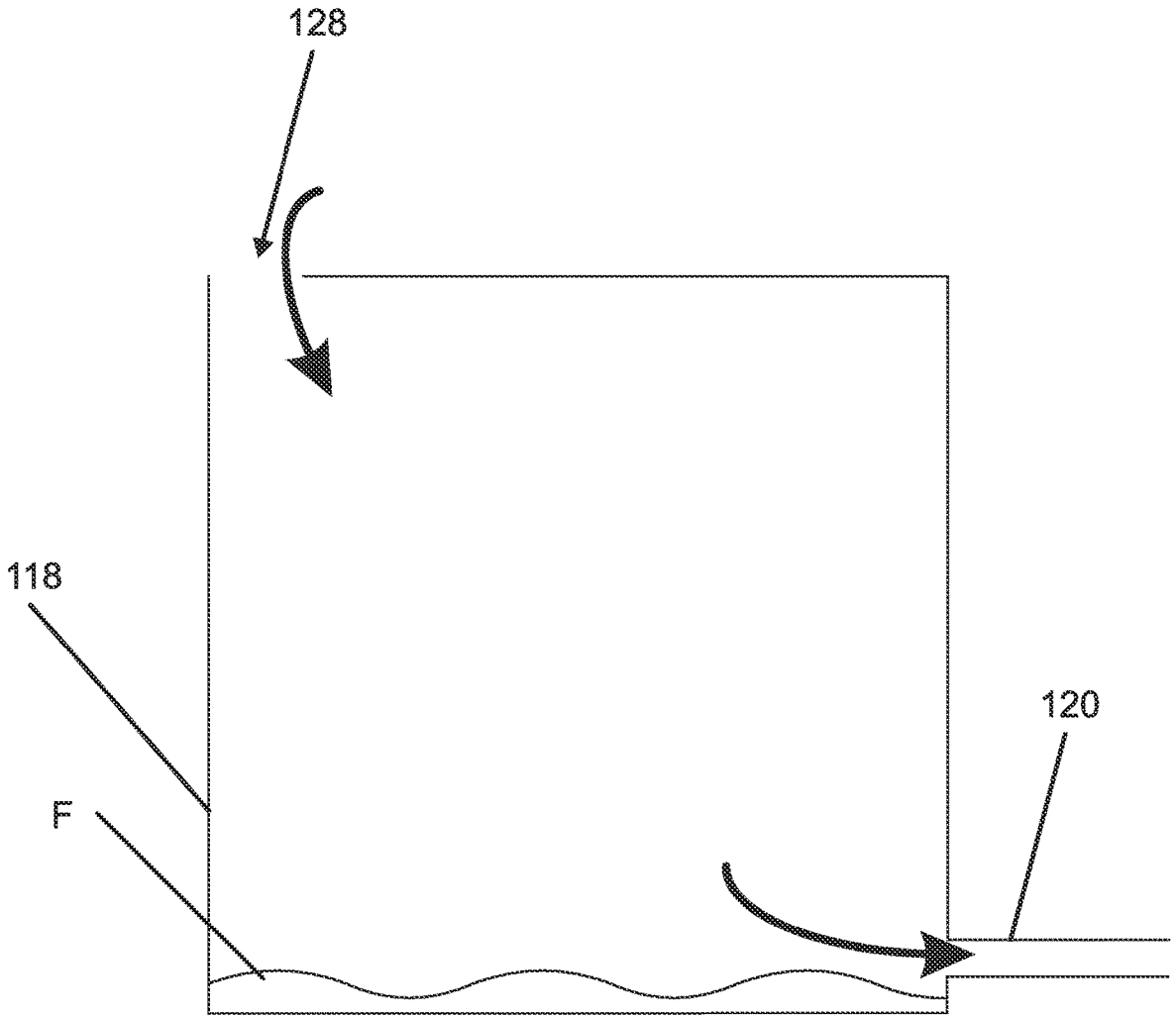
FIG. 7 is a schematic view of the auxiliary DEF tank of FIG. 2 with a low level of DEF fluid contained therein.

FIG. 7 is a schematic diagram of the auxiliary DEF tank 118, as shown in FIG. 2. The auxiliary DEF tank 118 of FIG. 7 shows the DEF fluid level F at a point that is lower than the point at which the external auxiliary DEF line 120 is connected to the auxiliary DEF tank 118. In some examples, such as in operations 208, 308, and 408, described with reference to FIGS. 4, 5, and 6, the pump 114 may continue to operate after the DEF fluid level F in the auxiliary DEF tank 118 has dropped to a level at which the DEF fluid level F is lower than the point at which the external auxiliary DEF line 120 is connected to the auxiliary DEF tank 118. In some examples, the continued operation of the pump 114 will result in the in the pump drawing air from the vent 128 through the auxiliary DEF tank 118, the external auxiliary DEF line 120, the enclosure pass through 116, the first internal auxiliary DEF line 122, the pump 114, second internal auxiliary DEF line 124 and into the onboard DEF tank 112. In such cases, the continued operation of the pump 114 will result in DEF being purged from the external auxiliary DEF line 120, the enclosure pass through 116, the first internal auxiliary DEF line 122, the pump 114, and the second internal auxiliary DEF line 124.

Figure 8:
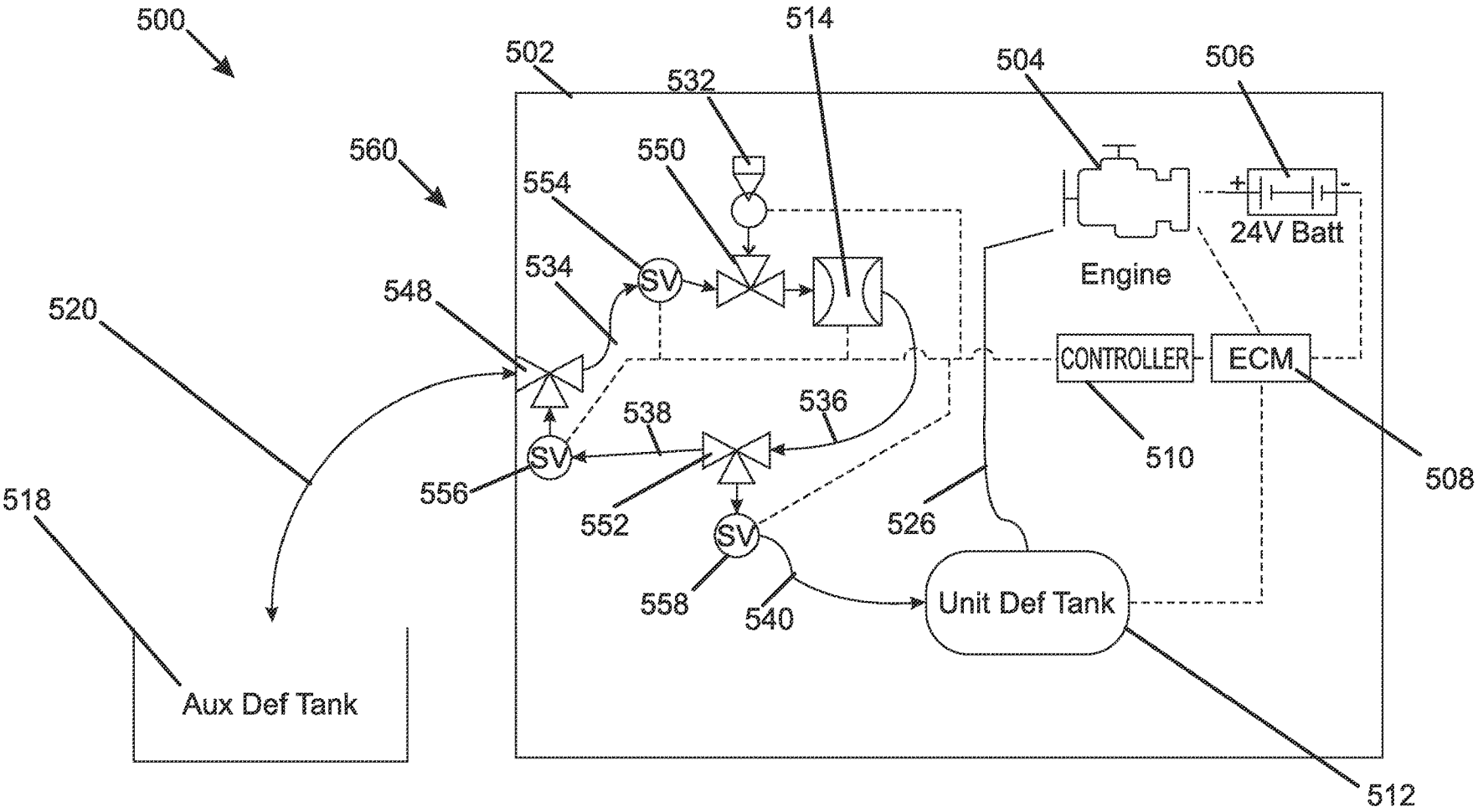
FIG. 8 is a schematic view of another example diesel emissions control system.

FIG. 8 is an alternative embodiment of a diesel emissions control system 500. As shown in FIG. 8, the diesel emissions control system 500 includes an enclosure 502, an engine 504, a battery 506, an engine control module 108, a controller 510, and a DEF fluid pathway 560. In some examples, the DEF fluid pathway 560 comprises an onboard DEF tank 512, a pump 514, a first tee fitting 516, an auxiliary DEF tank 518, an external auxiliary DEF line 520, an engine DEF supply line 526, a vent 532, a first internal auxiliary DEF line 534, a second internal auxiliary DEF line 536, a third internal auxiliary DEF line 538, a fourth internal auxiliary DEF line 540, tee fittings 548, 550, 552, valves 554, 556, 558. While FIG. 8 illustrates one auxiliary DEF tank 518 and one onboard DEF tank 512, in some examples, multiple auxiliary DEF tanks and multiple onboard DEF tanks are used. In some examples, the diesel emissions control system 500 is installed in a generator.

As shown in the example of FIG. 8, the enclosure 502 houses the engine 504, a battery 506, an engine control module 108, a controller 510, an onboard DEF tank 512, a pump 514, an auxiliary DEF tank 518, an external auxiliary DEF line 520, an engine DEF supply line 526, a vent 532, a first internal auxiliary DEF line 534, a second internal auxiliary DEF line 536, a third internal auxiliary DEF line 538, a fourth internal auxiliary DEF line 540, tee fittings 548, 550, 552, valves 554, 556, 558. In the example of FIG. 8, the auxiliary DEF tank 518 and the external auxiliary DEF line 520 are arranged outside of the enclosure 502.

The engine 504 and the battery 506 are substantially the same as the engine 104 and the battery 106 described with reference to FIG. 1.

The engine control module 508 is connected to the battery 506 by an electrical connection. The engine control module 508 reads values from sensors, interprets the data from the sensors, and communicates signals to other parts of the diesel emissions control system 500. In some examples, the engine control module 508 is electrically connected to and sends and/or receives signals to/from the controller 510, the engine 504, and the onboard DEF tank 512.

The controller 510 is connected to the engine control module 508 by an electrical connection. The controller 510 communicates signals from the engine control module 508 to other components of the diesel emissions control system 500. In the example illustrated in FIG. 8, the controller 510 communicates signals to the pump 514, the vent 532, and valves 554, 556, 558.

The pump 514 is connected to the controller 510 by an electrical connection. In some examples, the controller 510 controls the operation of the pump 514. In some examples, the pump 514 is a single direction diaphragm pump. In some examples, the controller 510 controls the operational status of the pump (whether the pump is on or off).

As shown in FIG. 8, each of the components of the DEF fluid pathway 560 are fluidly connected with each other.

In some examples, the valves 554, 556, 558 are each solenoid valves, that can be selectively opened and closed by the controller 110. In other examples, other types of valves may be used, such as, for example, a motorized valve.

In some examples, the vent 532 is comprised of a solenoid valve. In some examples, the vent 532 further comprises a filter. In some examples, the vent 532 is configured to selectively enable fluid communication of the DEF fluid pathway 560 with the external environment. In some examples, the vent 532 is arranged above the other components of the DEF fluid pathway 560 such that when the vent 532 is opened, the DEF within the DEF fluid pathway 560 does not escape from the DEF fluid pathway 560 through the vent 532.

In some examples, the auxiliary DEF tank 518 further includes a vent 528 and is configured and connected to the external auxiliary DEF line 520 in substantially the same way as the auxiliary DEF tank 118, as described with reference to FIGS. 2 and 7.

Likewise, in some examples, the onboard DEF tank 512 further includes a vent and a fluid level sensor. In some examples, the vent and the fluid level sensor of the onboard DEF tank 512 are configured in substantially the same way as the vent 132 and the fluid level sensor 130 of the onboard DEF tank 112 described with reference to FIG. 3. Likewise, in some examples, the onboard DEF tank 512 is configured and connected to the fourth internal auxiliary DEF line 540 and the engine DEF supply line 526 in substantially the same way as the onboard DEF tank 112 is configured and connected to the second internal auxiliary DEF line 124 and engine DEF supply line 126, as described with reference to FIG. 3.

Figure 9:
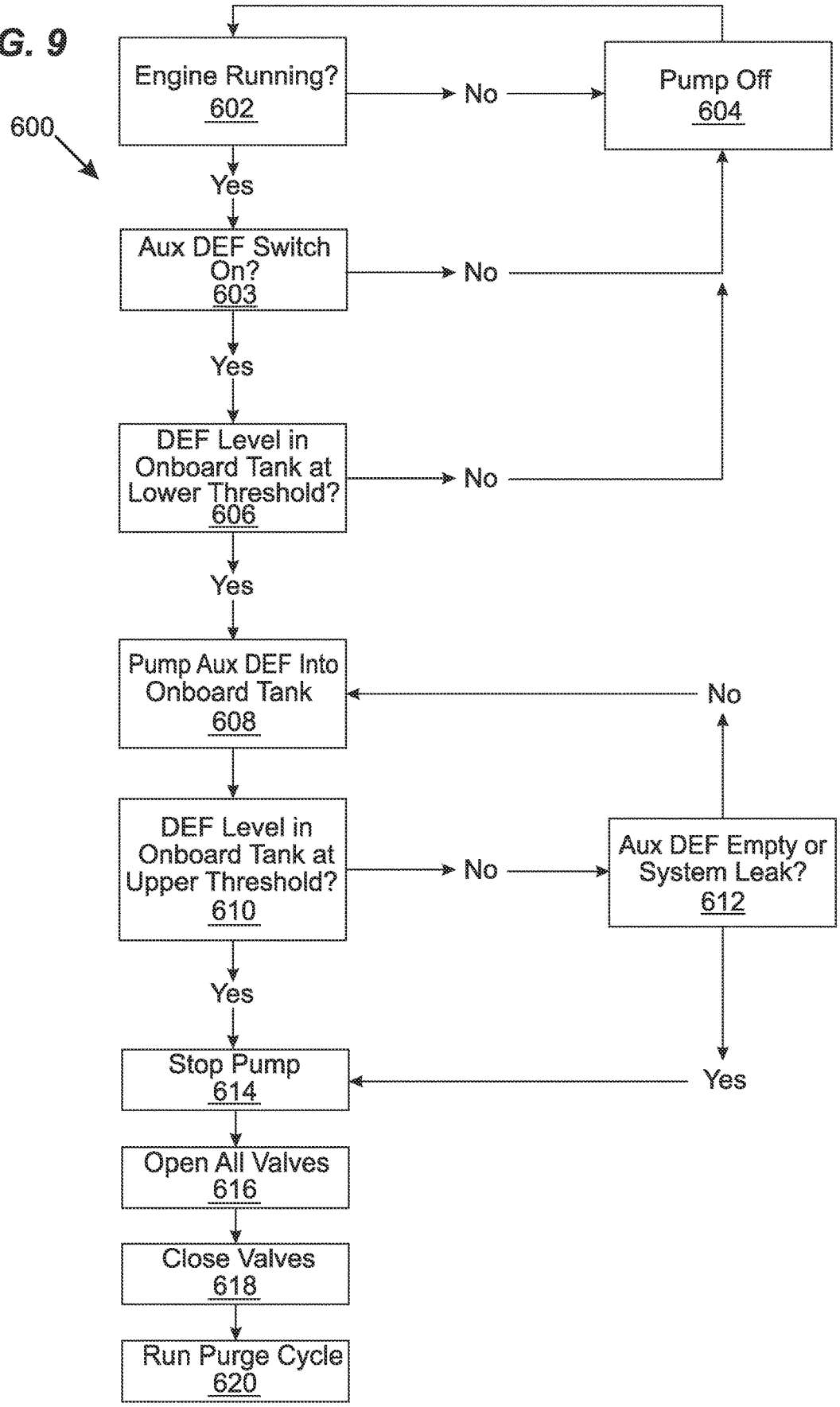
FIG. 9 is a flowchart of another example method of using a diesel emissions control system.

FIG. 9 is a flowchart of a method 600 of using a diesel emissions control system, such as the diesel emissions control system 500. The method 600 includes operations 602, 603, 604, 606, 608, 610, 612, 614, 616, 618, and 620.

Operation 602 includes checking whether the engine is running. In some examples, operation 602 is performed by the controller 510 to determine whether the engine 504 is running. If, in operation 602, it is determined that the engine 504 is not running, operation 604 is performed. If, in operation 602, it is determined that the engine 504 is running, operation 606 is performed.

Operation 604 includes turning off the pump. In some examples, operation 604 is performed by the engine control module 508 communicating a signal to the controller 510 which results in the controller 510 cutting off power to the pump 514 to turn off the pump 514. In some examples after operation 604 is complete, operation 602 is performed.

Operation 603 includes determining whether an auxiliary DEF tank switch is on. In some examples, the auxiliary DEF switch is included in the diesel emissions control system 500 and is selectively adjustable by a user. In some examples, the auxiliary DEF switch is selectively adjustable between an "on" and an "off" position. In some examples, the auxiliary DEF switch is placed into the "on" position when the auxiliary DEF tank 518 is connected to the diesel emissions control system 500. In some examples, the auxiliary DEF switch is placed into the "off" position when the auxiliary DEF tank 518 is not connected to the diesel emissions control system 500. In some examples, the position of the auxiliary DEF switch is adjusted automatically by the diesel emissions control system 500 based on whether the presence of the auxiliary DEF tank 518 is detected. In other examples, the auxiliary DEF switch is adjusted by a user based on whether the user has connected the auxiliary DEF tank 518 to the diesel emissions control system. In some examples, operation 603 is performed before operation 602. In other examples, as illustrated in FIG. 9, operation 603 is performed after operation 602. If, in operation 603, it is determined that the auxiliary DEF switch is not on, operation 604 is performed. If, in operation 603, it is determined that the auxiliary DEF switch is on, operation 606 is performed.

Operation 606 includes determining whether the fluid level of DEF in an onboard DEF tank is at or below a lower threshold. In some examples, operation 606 is performed by the controller 510 to determine whether the fluid level of DEF in the onboard DEF tank 512 is at or below a lower threshold. In some examples, the lower threshold is about 20% of the capacity of the onboard DEF tank 512 (such as, for example, 20% of the capacity of the onboard DEF tank 512). In other examples, the lower threshold is about 30% of the capacity of the onboard DEF tank 512 (such as, for example, 30% of the capacity of the onboard DEF tank 512). In some examples, the lower threshold is any value between about 0% to about 30% of the capacity of the onboard DEF tank 512 (such as, for example, any value between 0% and 30% of the capacity of the onboard DEF tank 512). In some examples, the engine control module 508 performs operation 606 by receiving a signal from the fluid level sensor 630 in the onboard DEF tank 512 indicative of the fluid level of DEF in the onboard DEF tank 512. In some examples, if, in operation 606, it is determined that the fluid level of DEF in an onboard DEF tank is not at or below the lower threshold, operation 604 is performed. If, in operation 606, it is determined that the fluid level of DEF in an onboard DEF tank is at or below the lower threshold, operation 608 is performed.

Operation 608 includes pumping DEF from an auxiliary DEF tank into an onboard DEF tank. In some examples, operation 608 is performed by the pump 514 to pump DEF from the auxiliary DEF tank 518 into the onboard DEF tank 512. In some examples, operation 608 is initiated by the engine control module 508 providing one or more signals to the controller 510. The controller 510, generates signals to the vent 532 and valves 554, 556, 558 which causes the vent 532 and valve 556 to close and causes valves 554 and 558 to open. The controller 510 then signals the pump 514 to initiate pumping, which causes the pump to draw DEF from the auxiliary DEF tank 518, through the external auxiliary DEF line 520, tee fitting 548, first internal auxiliary DEF line 534, valve 554, tee fitting 550, pump 514, second internal auxiliary DEF line 536, tee fitting 552, valve 558, fourth internal auxiliary DEF line 540, into the onboard DEF tank 512. In some examples, operation 608 includes pumping a predetermined amount of DEF from an auxiliary DEF tank by performing a predetermined number of pump cycles or by operating the pump for a predetermined amount of time. In other examples, operation 608 is performed indefinitely until the pump 514 is interrupted.

Operation 610 includes determining whether the fluid level of DEF in an onboard DEF tank is at or above an upper threshold. In some examples, operation 610 is performed simultaneously with operation 608. In other examples, operation 610 is performed sequentially after operation 608. In some examples, operation 610 is performed by the controller 510 to determine whether the fluid level of DEF in the onboard DEF tank 512 is at or above an upper threshold. In some examples, the upper threshold is about 80% of the capacity of the onboard DEF tank 512 (such as, for example, 80% of the capacity of the onboard DEF tank 512). In other examples, the upper threshold is about 70% of the capacity of the onboard DEF tank 512 (such as, for example, 70% of the capacity of the onboard DEF tank 512). In some examples, the upper threshold is any value between about 70% to about 100% of the capacity of the onboard DEF tank 512 (such as, for example, any value between 70% and 100% of the capacity of the onboard DEF tank 512). In some examples, the engine control module 508 performs operation 610 by receiving a signal from the fluid level sensor in the onboard DEF tank 512 indicative of the fluid level of DEF in the onboard DEF tank 512. In some examples, if, in operation 610, it is determined that the fluid level of DEF in an onboard DEF tank is not at or above the upper threshold, operation 612 is performed. If, in operation 610, it is determined that the fluid level of DEF in an onboard DEF tank is at or above the upper threshold, operation 614 is performed.

Operation 612 includes determining whether the auxiliary DEF tank is empty or that there is a system leak. In some examples, operation 612 is performed by the engine control module 508 to determine whether the auxiliary DEF tank 518 is empty or that there is a system leak. In some examples, the determination of whether the auxiliary DEF tank 518 is empty is made by directly measuring the DEF level in the auxiliary DEF tank 518 using a fluid level sensor within the auxiliary DEF tank 518.

In other examples, in operation 612, the determination of whether the auxiliary DEF tank 518 is empty or that there is a system leak is made by monitoring the DEF level in the onboard DEF tank 512 over time. In such examples, the engine control module 508 receives signals from the fluid level sensor indicative of the DEF level in the onboard DEF tank 512 and uses the signals to make a determination of whether the auxiliary DEF tank 518 is empty or that there is a system leak. In some examples, operation 612 is performed simultaneously with operation 608. In such examples, in operation 612, the DEF level of the onboard DEF tank 512 is monitored while the pump is pumping in the first direction over a period of time. If the DEF level of the onboard DEF tank 512 increases a predetermined amount over the period of time, then a determination is made that the auxiliary DEF tank 518 is not empty. If, however, the DEF level of the onboard DEF tank 512 does not increase a predetermined amount over the period of time, then a determination is made that the auxiliary DEF tank 518 is empty or that there is a system leak and operation 614 is performed.

In some examples, if, in operation 612, it is determined that the auxiliary DEF tank 118 is empty or that there is a system leak, an error message is generated to notify a user that the auxiliary DEF tank 118 is empty or that there is a system leak.

In some examples, each of operations 610 and 612 are performed simultaneously with operation 608. such that if, in operation 610, it is determined that the fluid level of DEF in an onboard DEF tank is not at or above the upper threshold and in operation 612, it is determined that the auxiliary DEF tank 518 is not empty, then operation 608 is continued. In some examples, operations 610 and 612 are performed multiple times while operation 608 is performed.

Operation 614 includes stopping the pump. In some examples, operation 614 involves stopping the operation of the pump 514. In some examples, operation 614 is performed by the engine control module 508 providing one or more signals to the controller 510. The controller 510 causes the pump 514 to stop pumping. After operation 614, operation 616 is performed.

Operation 616 includes opening all of the valves in the DEF fluid pathway 560. In some examples, operation 616 includes opening valve 554, 556, 558, and vent 532. In some examples, opening all of the valves results in gravity causing the DEF fluid in the DEF fluid pathway 560 to flow from the tee fitting 550 through the first internal auxiliary DEF line 534 and through the tee fitting 548 so as to purge the tee fitting 550 and the first internal auxiliary DEF line 534 of DEF. In some examples, opening all of the valves in the DEF fluid pathway 560 results in gravity causing some or all of the DEF fluid in the DEF fluid pathway to flow from some or all of the various components in the DEF fluid pathway 560 into one or both of the auxiliary DEF tank 518 and/or the onboard DEF tank 512 so as to purge some or all of the various components in the DEF fluid pathway 560 of DEF. In some examples, operation 616 is performed for a predetermined amount of time, such as, for example, five seconds. In other examples, operation 616 is performed indefinitely. In some examples, operation 616 is initiated by the engine control module 508 providing one or more signals to the controller 510. The controller 510, generates signals to the vent 532 and valves 554, 556, 558 which causes the vent 532 and valves 554, 556, 558 to open. In some examples, operation 618 is performed after operation 616.

Operation 618 includes closing a predetermined assortment of valves. In some examples, operation 618 is initiated by the engine control module 508 providing one or more signals to the controller 510. In some examples, the controller 510, generates one or more signals to the vent 532 and/or valves 554, 556, 558 which causes the vent 532 and valve 556 to open and causes valves 554 and 558 to close. In other examples, the one or more signals causes the vent 532 and valve 558 to open and causes valves 554 and 556 to close. In other examples, the one or more signals causes the vent 532 and valves 556, 558 to open and causes valve 554 to close. In some examples, operation 620 is performed after operation 618 is performed.

Operation 620 includes running a purge cycle. In some examples, running a purge cycle includes pumping from a unit DEF tank into an auxiliary DEF tank. In some examples, operation 620 is performed by the pump 514 pumping air from the vent 532 through the pathway in the DEF fluid pathway 560 created by the assorted open valve pattern described above with respect to operation 618. In some examples, operation 620 is initiated by the engine control module 508 providing a signal to the controller 510 and the controller 510 to power the pump 514 which causes the pump 114 to pump air through the various pathways in the DEF fluid pathway 560. The pumping of the air through the various pathways in the DEF flow pathway causes the DEF in the various pathways to be pumped into one or more of the auxiliary DEF tank 518 or the onboard DEF tank 512.

Figure 10:
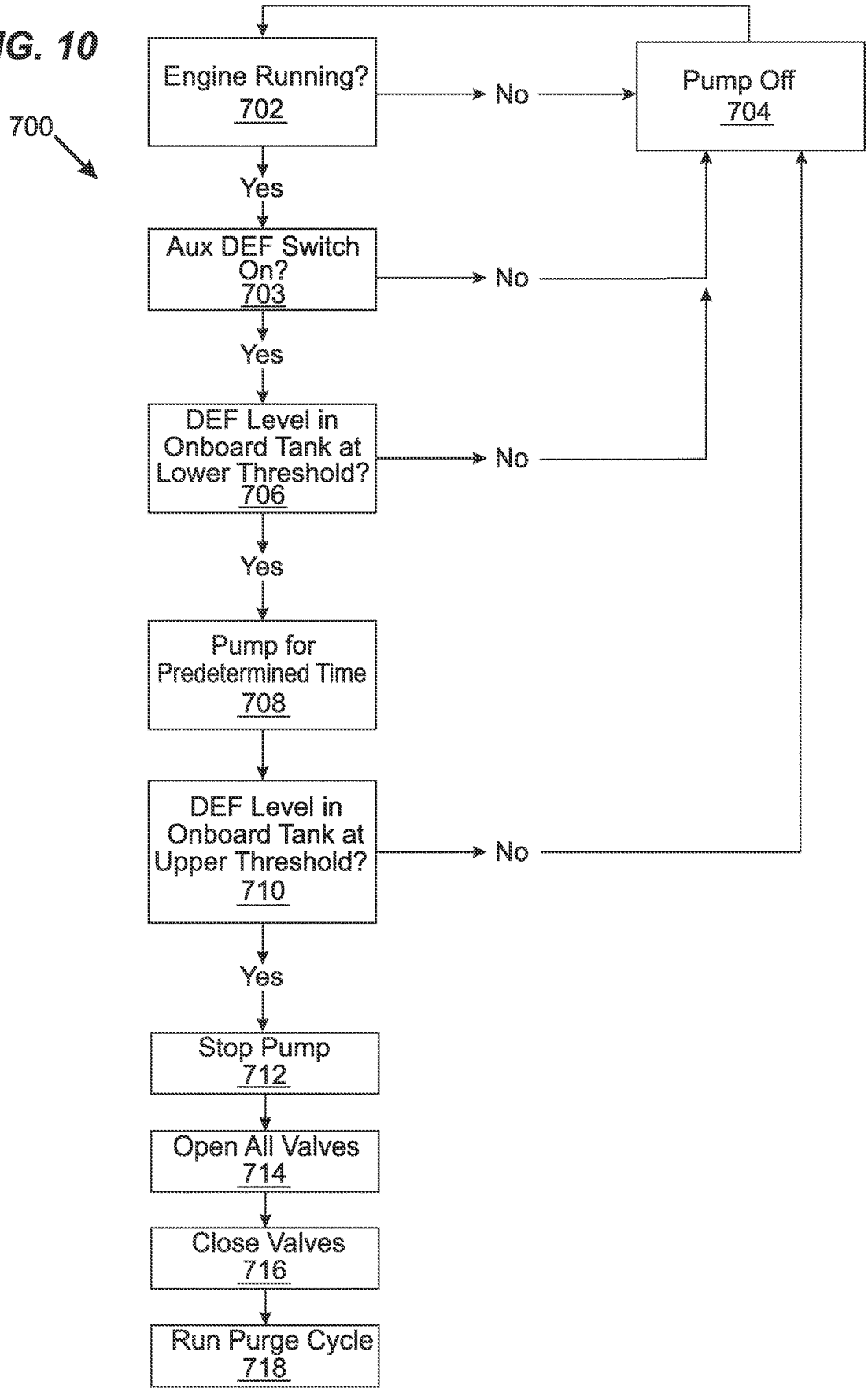
FIG. 10 is a flowchart of another example method of using a diesel emissions control system.

FIG. 10 is a flowchart of a method 700 of using a diesel emissions control system, such as the diesel emissions control system 500. The method 700 includes operations 702, 703 704, 706, 708, 710, 712, 714, 716, 718, and 720.

Operations 702-706 are performed in a substantially similar manner to operations 602-606 in FIG. 9. If, in operation 706, it is determined that the fluid level of DEF in an onboard DEF tank is at or below the lower threshold, operation 708 is performed.

Operation 708 includes pumping for a predetermined time. In some examples, operation 708 is performed by the pump 514 to pump DEF from the auxiliary DEF tank 518 into the onboard DEF tank 512. In some examples, operation 708 is initiated by the engine control module 508 providing one or more signals to the controller 510. The controller 510, generates signals to the vent 532 and valves 554, 556, 558 which causes the vent 532 and valve 556 to close and causes valves 554 and 558 to open. The controller 510 then signals the pump 514 to initiate pumping, which causes the pump to draw DEF from the auxiliary DEF tank 518, through the external auxiliary DEF line 520, tee fitting 548, first internal auxiliary DEF line 534, valve 554, tee fitting 550, pump 514, second internal auxiliary DEF line 536, tee fitting 552, valve 558, fourth internal auxiliary DEF line 540, into the onboard DEF tank 512. In some examples, the predetermined time is the sum of two time intervals, the first time interval being the amount of time that it takes to fill the onboard DEF tank 512 from the lower threshold to the upper threshold, and the second interval being the amount of time that it takes to completely purge the external auxiliary DEF line 520, tee fitting 548, the first internal auxiliary DEF line 534, valve 554, tee fitting 550, pump 514, second internal auxiliary DEF line 536, tee fitting 552, valve 558, and fourth internal auxiliary DEF line 540 with air. In some examples, the predetermined amount of time is only the first time interval.

Operation 710 includes determining whether the fluid level of DEF in an onboard DEF tank is at or above an upper threshold. In some examples, operations 710 and 712 are performed simultaneously with operation 708. In some examples, operation 710 is performed by the controller 510 to determine whether the fluid level of DEF in the onboard DEF tank 512 is at or above an upper threshold. In some examples, the upper threshold is about 80% of the capacity of the onboard DEF tank 512 (such as, for example, 80% of the capacity of the onboard DEF tank 512). In other examples, the upper threshold is about 70% of the capacity of the onboard DEF tank 512 (such as, for example, 70% of the capacity of the onboard DEF tank 512). In some examples, the upper threshold is any value between about 70% to about 100% of the capacity of the onboard DEF tank 512 (such as, for example, any value between 70% and 100% of the capacity of the onboard DEF tank 512). In some examples, the engine control module 508 performs operation 710 by receiving a signal from the fluid level sensor in the onboard DEF tank 512 indicative of the fluid level of DEF in the onboard DEF tank 512. In some examples, if, in operation 710, it is determined that the predetermined time has elapsed and that the fluid level of DEF in the onboard DEF tank 512 is not at or above the upper threshold, operation 704 is performed. If, in operation 710, it is determined that the fluid level of DEF in an onboard DEF tank is at or above the upper threshold, operation 714 is performed.

Operation 712 includes interrupting operation 708 to stop the pump from pumping. In some examples, operation 712 is performed by the engine control module 508 communicating a signal to the controller 510. The controller 510 cuts off power to the pump 514, which causes the pump 514 to stop pumping. In some examples, operation 712 causes to pump 514 to stop pumping before the predetermined time has elapsed. In some examples, operation 714 is performed after operation 312.

Operations 714-718 are performed in a substantially similar manner to operations 616-620 in FIG. 9.

In some examples, the method 700 is performed without operation 710, in which case operation 712 is performed after operation 708 is completed.

Figure 11:
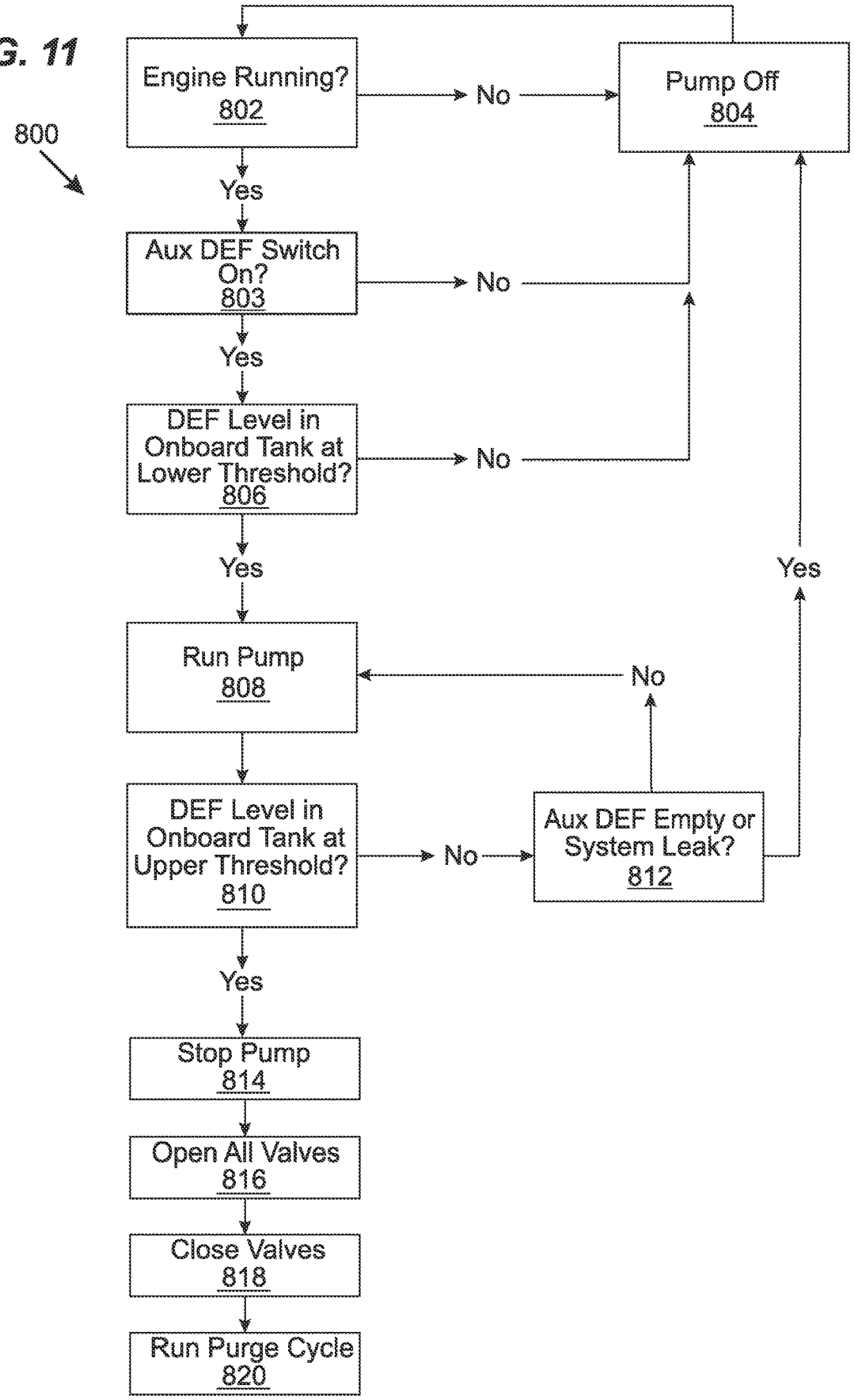
FIG. 11 is a flowchart of another example method of using a diesel emissions control system.

FIG. 11 is a flowchart of a method 800 of using a diesel emissions control system, such as the diesel emissions control system 500. The method 800 includes operations 802, 803, 804, 806, 808, 810, 812, 814, 816, 818, and 820.

Operations 802-806 are performed in a substantially similar manner to operations 602-606 in FIG. 9. If, in operation 806, it is determined that the fluid level of DEF in an onboard DEF tank is at or below the lower threshold, operation 808 is performed.

Operation 808 includes pumping DEF from an auxiliary DEF tank into an onboard DEF tank. In some examples, operation 808 is performed by the pump 514 to pump DEF from the auxiliary DEF tank 518 into the onboard DEF tank 512. In some examples, operation 808 is initiated by the engine control module 508 providing one or more signals to the controller 510. The controller 510, generates signals to the vent 532 and valves 554, 556, 558 which causes the vent 532 and valve 556 to close and causes valves 554 and 558 to open. The controller 510 then signals the pump 514 to initiate pumping, which causes the pump to draw DEF from the auxiliary DEF tank 518, through the external auxiliary DEF line 520, tee fitting 548, first internal auxiliary DEF line 534, valve 554, tee fitting 550, pump 514, second internal auxiliary DEF line 536, tee fitting 552, valve 558, fourth internal auxiliary DEF line 540, into the onboard DEF tank 512. In some examples, operation 808 is performed indefinitely until the pump 514 is interrupted.

Operation 810 includes determining whether the fluid level of DEF in an onboard DEF tank is at or above an upper threshold. In some examples, operation 810 is performed simultaneously with operation 808. In some examples, operation 810 is performed by the controller 510 to determine whether the fluid level of DEF in the onboard DEF tank 512 is at or above an upper threshold. In some examples, the upper threshold is about 80% of the capacity of the onboard DEF tank 512 (such as, for example, 80% of the capacity of the onboard DEF tank 512). In other examples, the upper threshold is about 70% of the capacity of the onboard DEF tank 512 (such as, for example, 70% of the capacity of the onboard DEF tank 512). In some examples, the upper threshold is any value between about 70% to about 100% of the capacity of the onboard DEF tank 512 (such as, for example, any value between 70% and 100% of the capacity of the onboard DEF tank 512). In some examples, the engine control module 508 performs operation 810 by receiving a signal from the fluid level sensor in the onboard DEF tank 512 indicative of the fluid level of DEF in the onboard DEF tank 512. In some examples, if, in operation 810, it is determined that the fluid level of DEF in the onboard DEF tank 512 is not at or above the upper threshold, operation 812 is performed. If, in operation 810, it is determined that the fluid level of DEF in an onboard DEF tank is at or above the upper threshold, operation 814 is performed.

Operations 812-820 are performed in a substantially similar manner to operations 612-620 in FIG. 9.

As noted above, in some examples, the auxiliary DEF tank 518 is configured substantially similar to the auxiliary DEF tank 118, shown in FIG. 7. The auxiliary DEF tank 118 of FIG. 7 shows the DEF fluid level F at a point that is lower than the point at which the external auxiliary DEF line 120 is connected to the auxiliary DEF tank 118. In some examples, such as in operations 608, 708, and 708, described with reference to FIGS. 9, 10, and 11, the pump 514 may continue to operate after the DEF fluid level F in the auxiliary DEF tank 518 has dropped to a level at which the DEF fluid level F is lower than the point at which the external auxiliary DEF line 520 is connected to the auxiliary DEF tank 518. In some examples, the continued operation of the pump 514 will result in the in the pump drawing air from the vent 528 through the auxiliary DEF tank 518, the external auxiliary DEF line 520, the tee fitting 548, the first internal auxiliary DEF line 534, the valve 554, the tee fitting 550, the pump 514, second internal auxiliary DEF line 536, the tee fitting 552, the valve 558, and the fourth internal auxiliary DEF line 540 and into the onboard DEF tank 512. In such cases, the continued operation of the pump 514 will result in DEF being purged from the external auxiliary DEF line 520, the tee fitting 548, the first internal auxiliary DEF line 534, the valve 554, the tee fitting 550, the pump 514, second internal auxiliary DEF line 536, the tee fitting 552, the valve 558, and the fourth internal auxiliary DEF line 540.

In some examples, the purge cycle described in operations 216, 316, 418, 620, 718, and 820 of FIGS. 4-6 and 9-11 is performed after a threshold level of DEF is detected. In other example, the purge cycle of operations 216, 316, 418, 620, 718, and 820 is additionally performed based upon other parameters. In some examples, the other parameters include, for example, determining that the engine 104, 504 is not running. In other examples, a purge cycle is initiated after detecting a "stop" signal, such as, for example, an "emergency stop' signal. In other examples, a purge cycle is initiated after detecting an engine start signal. In some examples, one or more of the above signals is detected and/or generated by the engine control module 108, 508. In some examples, one or more of the above signals is detected and/or generated by the controller 110, 510.

The various embodiments described above are provided by way of illustration only and should not be construed to limit the claims attached hereto. Those skilled in the art will readily recognize various modifications and changes that may be made without following the example embodiments and applications illustrated and described herein, and without departing from the full scope of the following claims.

What is claimed is:

1. A method of pumping diesel exhaust fluid (DEF) from an auxiliary DEF tank into an onboard DEF tank through a DEF line, the method comprising:

determining that the amount of DEF in the onboard DEF tank is at or below a lower threshold value;

activating a pump to pump DEF from the auxiliary DEF tank through the DEF line into the onboard DEF tank;

determining that the amount of DEF in the onboard DEF tank is at or above an upper threshold; and activating the pump to cause DEF to flow from the DEF line into the auxiliary DEF tank and to cause air to flow from the onboard DEF tank into the DEF line.

2. The method of claim 1, further comprising determining that an engine is running.

3. The method of claim 1, wherein activating the pump to cause DEF to flow from the DEF line into the auxiliary DEF tank comprises purging DEF from the DEF line in a diesel emissions control system.

4. The method of claim 1, wherein the upper threshold is between 70% and 100% of the volume of the onboard DEF tank.

5. The method of claim 1, wherein the pump is a reversible peristaltic pump.

6. The method of claim 5, wherein activating the pump to cause DEF to flow from the DEF line into the auxiliary DEF tank further comprises reversing the direction of the pump.

7. The method of claim 1, wherein the pump is a single direction diaphragm pump.

8. The method of claim 7, further comprising changing a position of one or more valves.

9. The method of claim 8, wherein the one or more valves comprise one or more solenoid valves configured to be selectively moved between an opened and closed position.

10. The method of claim 1, wherein the onboard DEF tank is located onboard a generator.

11. The method of claim 10, wherein the method is performed using a controller that is powered by a battery onboard the generator.

12. The method of claim 1, wherein the DEF line is connected to the onboard DEF tank at a top side of the onboard DEF tank.

13. The method of claim 12, wherein the onboard DEF tank further comprises a vent at the top side thereof.

14. The method of claim 13, wherein the DEF line is connected to the auxiliary DEF tank at a bottom side of the auxiliary DEF tank.

15. The method of claim 1, wherein activating the pump to cause DEF to flow from the DEF line into the auxiliary DEF tank comprises pumping air from the onboard DEF tank towards the auxiliary DEF tank.

16. The method of claim 1, wherein activating the pump to cause DEF to flow from the DEF line into the auxiliary DEF tank comprises pumping from the auxiliary DEF tank toward the onboard DEF tank for a predetermined time interval.

17. The method of claim 1, wherein the amount of DEF in the onboard DEF tank is determined using a fluid level sensor.

18. The method of claim 1, wherein the onboard DEF tank is heated by a heating element.

19. The method of claim 1, further comprising determining that an auxiliary DEF switch is on.

20. The method of claim 1, wherein the lower threshold value is between 0% and 30% of the volume of the onboard DEF tank.

* * * * *